United States Patent [19]

Spamer et al.

[11] 4,455,269

[45] Jun. 19, 1984

[54] DEVICE AND METHOD FOR FORMING IN SITU HORIZONTAL CONCRETE SLABS

[76] Inventors: Alfred B. Spamer; William J. Klueber, both of 1740 Joppa Rd., Baltimore, Md. 21234

[21] Appl. No.: 248,501

[22] Filed: Mar. 27, 1981

Related U.S. Application Data

[63] Continuation of Ser. No. 34,969, May 1, 1979, abandoned.

[51] Int. Cl.[3] ..... E04G 11/50

[52] U.S. Cl. ..... 264/31; 264/35; 264/333

[58] Field of Search ..... 264/31, 333, 35

[56] References Cited

U.S. PATENT DOCUMENTS 3,818,083 6/1974 Butts ..... 264/31

*Primary Examiner*—John A. Parrish

[57] ABSTRACT

This invention relates to a device and method for forming in situ cast reinforced concrete slabs, with removable forms and incorporating the upper portion or chord of a joist as in integral reinforcing member. Relating to a method and device that allows adjustable thickness concrete slabs to be cast in place by means of adjustable hangers, which are particularly adapted to work together, with a bar or beam form support for temporary form-sheets, in a substantially leakproof manner in conjunction with the upper portion or chord of a standard open web bar joist.

1 Claim, 3 Drawing Figures

FIG. 1
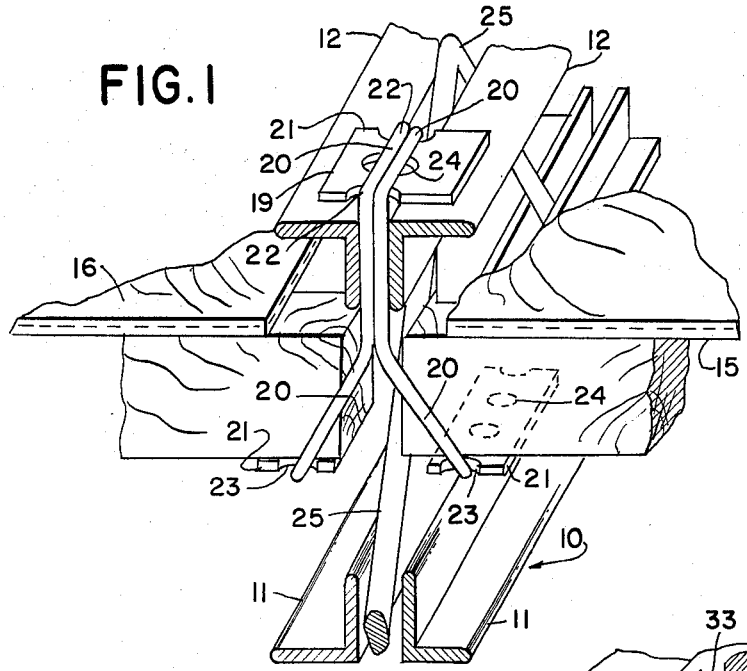
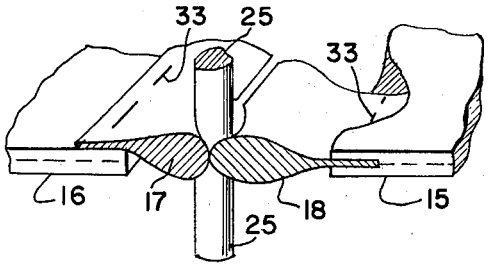
FIG. 3
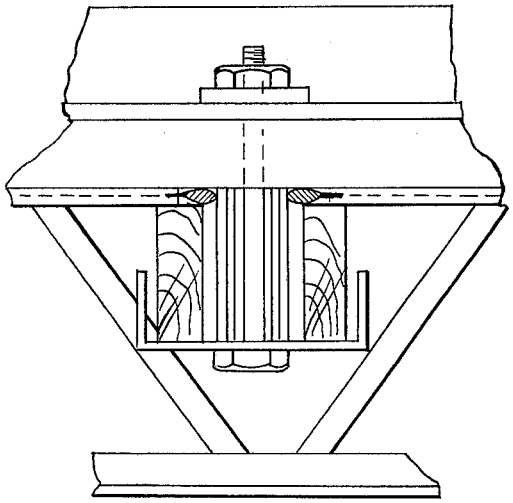
FIG. 2

DEVICE AND METHOD FOR FORMING IN SITU HORIZONTAL CONCRETE SLABS

This application is a continuation, of application Ser. No. 34,969, filed May 1, 1979 and now abandoned.

BACKGROUND OF THE INVENTION

The need for a method of temporarily supporting the semi-liquid material, generally known as concrete, while it is hardening, has existed almost as long as a self-hardening material (concrete or liquid stone) has been in existence. Some of the earlier patents such as that to Steiper, U.S. Pat. No. 827,268 show a removable method of fastening "flying scaffolding" to iron joist and here they taught fastening to "I" beams. Many, many ingenuous devices have been developed since that time with their ingenuity being directed to methods of removing the form after the material has hardened.

The following are listed as typical of those found in the art: Steiper, U.S. Pat. Nos. 827,268; Ducan, 1,502,092; Macomber, 1,796,851; Marks, 1,819,906; Selway, 1,625,056; Dell, 2,202,096; Faber, 2,218,705; Fribert, 2,297,952; Badt, 2,508,635; Olson, 2,575,678; Ledbetter, 2,609,585; Dreier, 3,093,932; Bowden, 3,130,470; Tooley, 3,294,357; Naillon, 3,341,639; Sullivan 3,405,903; Butts, 3,818,083; 3,189,143; 3,841,597; 3,845,594; 3,913,296; 3,945,168; and 4,015,396.

These patents show an orderly progression from inter-"I" beam bracing, for example, 1,652,056 to 2,609,585; then later with the beginnings of the development of bar joist formed devices, beginning with 2,297,952; through the bar lock devices such as shown in 3,945,168 and 4,015,396 and the various references that were cited in these patents.

This development from step to step clearly shows the effect of the economics of both the supply of materials and the reusability of some of the materials. Also reflected in the development is the increasing effect of labor, both on the shape of the device involved and the labor in assembling and disassembling the temporary form parts. Recently there has been developed the idea of secondary utility of the form parts after the temporary supports are removed. This is shown in devices such as shown in U.S. Pat. No. 3,341,639.

SUMMARY OF THE INVENTION

This invention relates to a structure which is comprised of a saddle-like structure that holds a standard timber member which in turn holds a standard or modified 4' by 8' or similar piece of sheet material or plywood, horizontal form member in special relationship, with the bar joist or open web joist member, positioning the horizontal form member so that it can be adjusted to form different thickness, concrete slabs, which can be cast combining the top cord member of the bar joist within the existing slab reinforcing system. Also, an advantage of this device is that the form elements are almost 100% commercially obtainable lumber units and timber units. The panels require only minimal modification to adapt them so they coact with the other form elements to make a removably attachable form system. This system requires minimum amount of reinforcing steel to develop the bar joist top chord with tie members and adjustable support members and they can be so used together to form and to provide an integral stress and strain system within the cast concrete member, after the form is removed.

BRIEF DESCRIPTION OF THE DRAWINGS

FIG. 1 shows a partial prospective view of the preferred embodiment of the invention.

FIG. 2 shows a partial elevational view of a modification of the invention.

FIG. 3 shows a detail in partial cross section perspective and elevational view of the end treatment of the plywood panel members, and resilient closing member.

DETAILED DESCRIPTION OF THE DISCLOSED EMBODIMENT

In the preferred embodiment of the hardware used in the in situ form, integral, open web truss, concrete deck fabricating system; referring particularly to FIG. 1, which shows a partial perspective view of a joint, between two form elements 15 and 16 of the system. An open web or bar joist 10 having angle members 11 and 12, is shown, end on, having notched hanger plate 19 placed on top of the bar joist, at the form member, stress responsive, distance from the next adjacent plate, not shown.

Then wire loops 20 locked into notches 21 and 22 of said plate 19. Then the two wire rectangular loops 20 (deformed to an obtuse angle) are inserted downwardly in between the opening of the V-shaped member 25 of the bar joist 10 with the plane of the wire loops being kept parallel to the adjacent faces of angle members 12 and also parallel with the length of the bar joist 10.

The side rungs of the rectangular wire loops 20 can be deformed (expanded) to receive the load distribution plate 21 which is attached or placed adjacent to lower surface of form supporting beam 13 and which plate 21 is similar in form and end notched, in the same manner as hanger plate 19. Usually the load plate 21 is attached to timber member 13 which can be nominally 3 inches by4 inches by sufficient (span) length that is needed to reach the next near proximity bar joist 10, and the timber member is inserted in the deformed opening in wire loop 20 with its plate 19 and 21 in place. The timber is covered then with a plywood form member which is removably attached in a known manner by nails or similar attaching means.

The plywood, two adjacent, form members 15 and 16, are placed, each form, on timber form support member 13 and 14 respectively. The mating edges 17 and 18 of these pieces of plywood form members 15 and 16 are fitted with a weatherstrip edge formed from a resilient weatherstrip commonly available at industrial supply sources. This or a similar item is attached to the mating edge or within an edge slot along the mating edge of the piece of plywood, by means of staples or other suitable fastening means. This provides an adjustable or resilient cushioning member which surrounds the diagonally descending and ascending members 25 of the bar joist 10 known as web members. This will prevent or substantially prevent any concrete spillage at the form joints when the in situ concrete deck is being poured. This procedure also avoids the problem of cutting and fitting individually around each of the bar joist members 25 in order to get a tight fit. Also, it allows the piece of plywood to be pushed in diagonally against the vertical portion of the bar joist member 10 in order to fit them in between the middle portion of two bar joists.

In construction, the wire mesh for reinforcing is draped over the top chord angle members 12, or portions, of the bar joists 10 top chords, and then when the concrete is poured, to the proper depth and sufficiently hardened, the wire rectangular loops 20 are either cut or burned so that they can, if necessary, be deformed in order to remove the 3×4 form supporting beam elements 13 and 14 and the overlaying plywood form material 15 and 16. The beams with their plates 21, still attached are now reusable, as is the plywood, with its weatherstrip edging 33 and their flexible "weatherstrip" edges 17 and 18. Each unit is reusable only requiring the usual oiling of the plywood and other surfaces in a manner already known in the trade. This oil should be applied before each second use of the form members in a new construction. The preferred spacing of joists and beams is to use a full (4 foot by 8 foot) sheet of plywood.

The first modification, FIG. 2, of a preferred embodiment uses a standard bolt 27 of length sufficient to locate the timber support or beam members 13 and 14, with their ends, adjacent the bolt support 29, and in side cradle 28. Altenately, they can be cantilevered, past a bolt portion and supported by a second bolt. These cradle members 29 with their beams 13 and 14 are located adjustably at a depth which when allowing for the covering of the plywood form member 15 which is placed above the beam membes 13 and 14 respectively, then permits the form member combination, to develop a slab of concrete-top chord bar joist-reinforcing composite of specified thickness. This structurally includes stressing over the top chord of the bar joist member 10 within the concrete slab. This method specifically does not include the bottom chord of the bar joist in the concrete, thus allowing for a composite modules of higher value, per pound of slab in place than is obtainable by prior methods. The thickness of the concrete slab is determined by the loading factor to which the concrete slab is to be subsequently exposed.

This support bolt 27 is provided with a nut 26 at the top thereof, and the bolt's head is at the bottom supporting cradle 28 which is a section of a U-shaped channel which in turn carries or supports the beam members 13 and 14. There is a load distributing washer or plate 19 placed under the nut 27 above and the nut and bolt are adjusted to bring the form-bearing or supporting beams 13 and 14 up to the desired level. Then, as in the prior example, the plywood 15 with its weatherstripped mating edge 18 is placed over top of and supported on these beams. Then the reinforcing mesh is then put in place over top of the bar joist, top chord, and then the concrete is poured to the desired thickness, then allowed to harden.

After hardening, cast in place concrete 32, the bolt 29 is "backed off" retrieving and releasing the "U" bracket beam cradle 28 and its beams 13 and 14 and the plywood forms 15 and 16 of the system. A plastic sheet 31 in tubular form to protect the bolt 27 from the adhesive quality of the concrete which has been placed around the bolt 27 prior to its insertion between the angle bars 12 and prior to adjustment, now allows the bolt to be easily withdrawn through the hardened concrete, without the difficulty of having to make any other separating or parting provisions. The top nut and washer and plastic sheeting stay embedded in the concrete to form a receiver for later slab attachments. The normal procedure is for the top-threaded-portion of the bolt, which might extend past the nut into the concrete, to be oiled in a known manner, so that when the form is removed the bolt can be removed which together the embedded nut 26 and washer and plastic tube which then form a "bonus pocket" or chase, that can receive a similar sized threaded bolt or hanger accesories at a later time, for any suspension item or element that is needed for subsequent applications of additional structures to the underside of the cast in place deck. Such attachments are used in mechanical runs and electrical runs, air conditioning, piping, etc. This embodiment applies primarily to "in situ" casting of a concrete slab with a standard open web steel joist as manufactured by the Steel Joist Institute, members. This adds flexibility and economy and versatility by using existing commercially available joist components, and lumber components in a compatable coaction for the above particularized functions and structures.

I claim:

1. A method of in situ forming cast horizontal concrete slabs which employs form boards, a plurality of joists, each having at least a pair of spaced top bar elements forming a substantially continual slot and a bottom bar element, and having a zig zag web member periodically connecting between the said top and bottom bar elements, along the length thereof, the steps of:

orienting a plurality of said joists in a generally parallel spaced relation, with their opposite ends supported substantially level, inserting deformable aperture members for supporting a bar in spaced relation within said slot formed by the upper rails of said joists, and depending and spaced substantially below said spaced top bar elements deforming said deformable aperture members and inserting thru said aperture members the ends of spanner bars, having transversely extended notched wing tabs at spaced intervals for defining notches, said spanner bars depending from the supporting aperture members of at least two adjacent joists, said bars spanning the distance therebetween, generally set at right angles thereto, releasing said deformable aperture member for locking said notches into said aperture members, and placing rigid panels having at least two opposite deformable edges tightly against the side of the webing apertures of said joists and of said aperture members supporting said spanner bars at a ratio of at least two bars per panel, and filling substantially all the horizontal space and surrounding all of the upper portion of the adjacent joists, with concrete.

* * * * *